US007926120B2

(12) United States Patent
Birmingham

(10) Patent No.: US 7,926,120 B2
(45) Date of Patent: Apr. 19, 2011

(54) ISOLATION GARMENT AND FOOT WARE

(76) Inventor: McCann D. Birmingham, New Britain, CT (US)

( * ) Notice: Subject to any disclaimer, the term of this patent is extended or adjusted under 35 U.S.C. 154(b) by 0 days.

(21) Appl. No.: 12/220,599

(22) Filed: Jul. 25, 2008

(65) Prior Publication Data

US 2010/0017937 A1 Jan. 28, 2010

(51) Int. Cl.
*A41D 13/04* (2006.01)

(52) U.S. Cl. ..... 2/51; 2/52

(58) Field of Classification Search ..... 2/51, 901, 2/456, 82, 114, 48, 49.1, 52, 74, 79, 46, 49.4, 2/50, 76, 83, 85, 87, 104–106, 69, 115, 457; D2/860, 861, 720, 739
See application file for complete search history.

(56) References Cited

U.S. PATENT DOCUMENTS

| | | | | | |
|---|---|---|---|---|---|
| 431,332 | A * | 7/1890 | Chadwick | 2/48 |
| 492,643 | A * | 2/1893 | Oostrum | 2/82 |
| 717,854 | A * | 1/1903 | Holston | 2/51 |
| 1,543,582 | A * | 6/1925 | Mackay | 2/228 |
| 1,548,830 | A * | 8/1925 | Dunsworth | 2/48 |
| 1,620,743 | A * | 3/1927 | Stuart | 36/2 R |
| 1,888,629 | A * | 11/1932 | Kass | 2/48 |
| 2,335,667 | A * | 11/1943 | Hahn | 2/64 |
| 2,429,625 | A * | 10/1947 | Horn | 2/61 |
| 2,668,294 | A * | 2/1954 | Gilpin | 2/114 |
| 2,679,647 | A * | 6/1954 | Gossner | 2/82 |
| 2,846,686 | A * | 8/1958 | Tames | 2/114 |
| 3,921,221 | A * | 11/1975 | Zoephel | 2/51 |
| 3,946,443 | A * | 3/1976 | Knight | 2/82 |
| 4,152,782 | A * | 5/1979 | Kincaid | 2/74 |
| 4,304,006 | A * | 12/1981 | Swart | 2/49.1 |
| 4,773,100 | A * | 9/1988 | Kuo | 2/46 |
| 4,829,602 | A * | 5/1989 | Harreld et al. | 2/51 |
| 5,005,216 | A * | 4/1991 | Blackburn et al. | 2/79 |
| 5,142,704 | A * | 9/1992 | Viemeister et al. | 2/202 |
| 5,444,873 | A * | 8/1995 | Levin | 2/114 |
| 5,588,155 | A * | 12/1996 | Baker et al. | 2/123 |
| 6,851,125 | B2 * | 2/2005 | Fujikawa et al. | 2/51 |
| 6,934,969 | B2 * | 8/2005 | Schorr et al. | 2/51 |
| 6,948,187 | B2 * | 9/2005 | Drake | 2/51 |
| 7,013,488 | B2 * | 3/2006 | Lewis et al. | 2/51 |
| 7,647,648 | B2 * | 1/2010 | Komorowski | 2/51 |
| 2008/0092263 | A1 * | 4/2008 | Good et al. | 2/49.1 |
| 2008/0115253 | A1 * | 5/2008 | Gorman | 2/84 |

* cited by examiner

*Primary Examiner* — Amy B Vanatta

(57) ABSTRACT

The Impervagown and Impervashoe are made of material/fabric that is impervious to all fluids and liquids. The Impervawear prevents and protects against cross-contamination of harmful or negative fluids. This protection allows employees to work comfortably and effectively in dry clothing for the duration of their work shift. By doing so, employees will be more confident in their approach to patient care, specifically giving "showers". Most importantly, the purpose of Impervawear is to allow for an increase in patient "showers" improving hygiene, decreasing the probability of bedsores and allowing patients to experience the peace of mind and confidence they deserve.

2 Claims, 4 Drawing Sheets

ISOLATION GARMENT AND FOOT WARE

BACKGROUND OF THE INVENTION

Clothing and foot ware that is impervious (or semi-impervious) to fluids in a health care setting are known, and are mainly used to protect employees that work in high risk areas of healthcare facilities (i.e. hospitals, emergency rooms, surgery) to protect against contact of blood, saliva, etc, with the skin of the worker. However, in areas that have a lesser risk of bodily fluid contamination, such as rehabilitation facilities, nursing homes and private nursing, the isolation gowns worn to protect health care workers from varying problematic situations still allow a portion of the liquids/fluids to penetrate through the fabric, thus exposing the workers and patients to cross-contamination and transmission risks (MRSA, etc). Additionally, these isolation gowns are not configured to protect the employees clothing and footwear from becoming wet while giving showers to patients (whether the patient is in a shower stretcher, shower chair, or even getting washed in bed).

SUMMARY OF THE INVENTION

An isolation gown for covering a body of a wearer is provided, wherein the isolation gown includes a body cover portion, where the body cover portion is configured as a gown to cover the body of the wearer between an area proximate a neck area of the wearer and an ankle area of the wearer, wherein the body cover portion is open near the ankle area of the wearer. The isolation gown includes two sleeve portions each having an arm opening, wherein each of the two sleeve portions is configured to terminate proximate a wearers hand, such that each arm of the wearer up to an area proximate a hand portion of the wearer is covered by one of the two sleeve portions, wherein each of the arm opening includes an elastic portion to resiliently contact the arm, and a back opening having a tie portion, wherein the tie portion is configured to allow the isolation gown to be secured to the wearer, wherein each of the body cover portion and the two sleeve portions are constructed from a material impervious to liquids, where the liquids includes at least one of water and bodily fluids.

An isolation foot ware for covering a shoe of a wearer is provide, wherein the isolation foot ware includes a show cover portion, where the shoe cover portion is configured to cover an ankle portion and the shoe of the wearer, wherein the shoe cover portion includes a leg opening and a heel opening, wherein when worn by a wearer the heel opening is configured to keep the heel portion exposed and the leg opening is configured to elastically interact with a leg portion of the wearer, wherein the shoe cover portion is constructed from a material impervious to liquids, where the liquids includes at least one of water and bodily fluids.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

Figure 1:
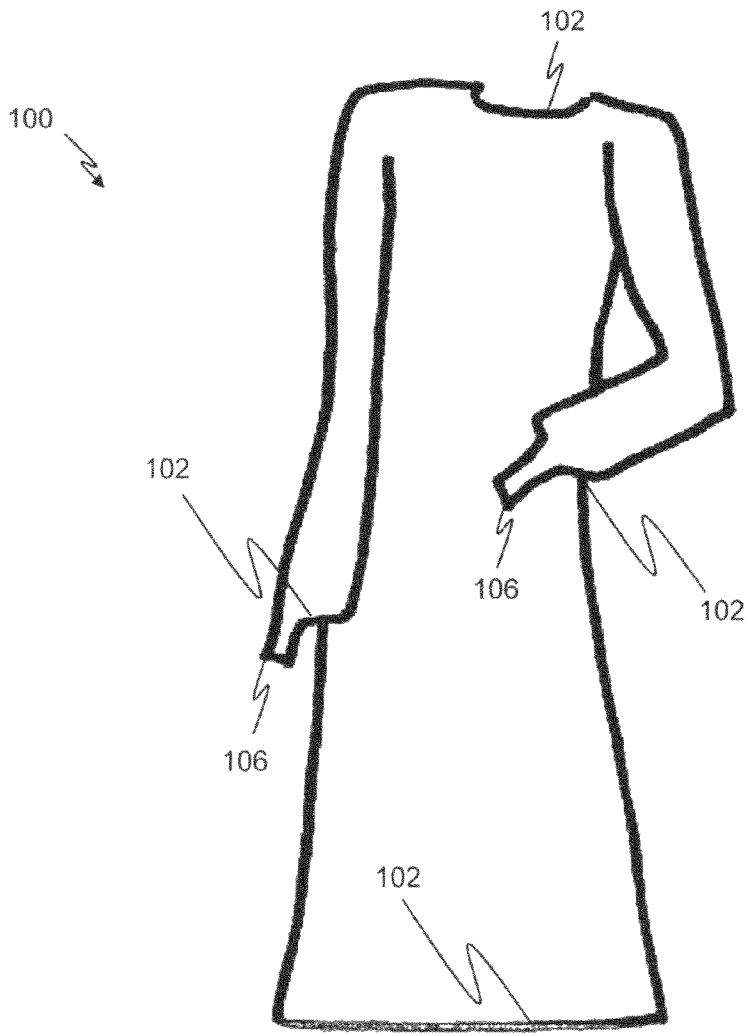
FIG. 1 illustrates a front view of an isolation gown, in accordance with the present invention.
Figure 2:
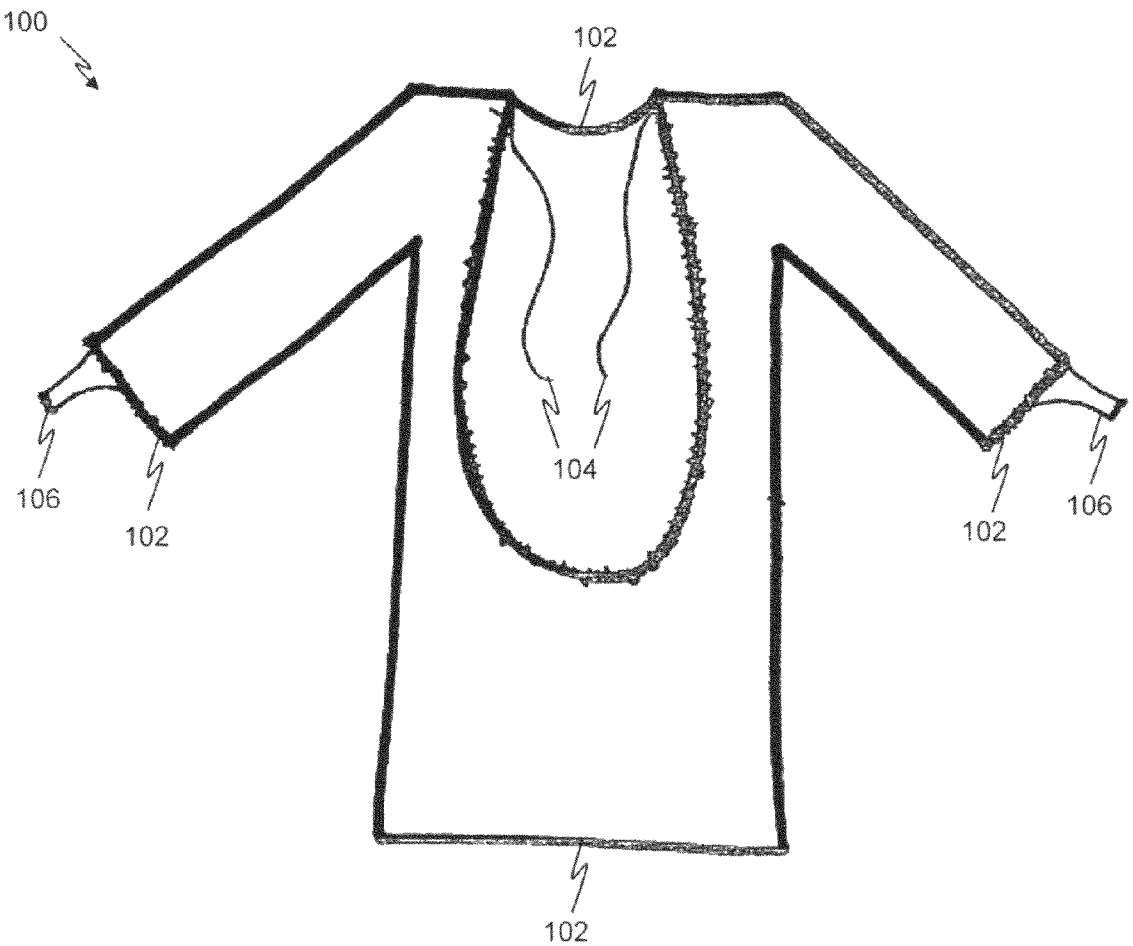
FIG. 2 illustrates a back view of the isolation gown of FIG. 1.

As disclosed herein with regards to an exemplary embodiment, an isolation gown 100 and isolation foot ware 200 is described. Referring to FIG. 1 and FIG. 2, isolation gown 100 is shown and is a multifunctional gown that can be easily worn by health care workers, such as RN's and CNA's, to provide isolation from liquids and bodily fluids from patients during non-surgical hygienic procedures. As can be seen, isolation gown 100 is configured to cover the majority of the wearer's body down to an area which is proximate to the foot portion of the wearer. The isolation gown 100 includes an open back portion 102 having a tie portion 104 to allow the isolation gown 100 to be secured and to accommodate wearers of different sizes. The sleeves of the isolation gown 100 are configured to cover the majority of the arms of the wearer such that gloves can cover the portion of the wearers arm not covered by the isolation gown 100.

Isolation gown 100 is made of material that provides isolation from fluids, such as quality impervious materials provided by Du Pont and other manufacturers. Accordingly, the material used to construct isolation gown 100 may be flame resistant, waterproof, blood stain resistant, and proofed for accumulation of moisture. Isolation gown 100 includes several openings 102 that have elastic boarders for providing a secure fit to areas of the wearer to prevent or minimize intrusion of fluids while allowing for a full range of movement. Additionally, the isolation garment 100 also includes thumbhooks or hand anchors 106 to prevent the sleeves from retracting away from the hand portion of the wearer, where the anchors 106 wrap around the respective hand of the wearer to cross the palm of the hand. Furthermore, the isolation gown 100 includes highly protective gathers on the garment that helps to further prevent the medical staff from becoming wet while giving showers while having a full range of movement. This will restore the confidence of the staff to proceed with giving their patients showers without having to perform the rest of their daily functions in wet clothing.

Furthermore, the isolation gown may be conveniently located and stored in individually wrapped packages for ease of use and the binding of this extraordinary fabric assists with common tasks such as dressing/undressing open wounds and uncontrollable bladders, while providing the isolation to prevent cross contamination. In accordance with the present invention, the isolation garment 100 may be constructed from several pieces of quality impervious materials or isolation garment 100 may be constructed from one piece of quality impervious material and may include gathers that are located in key areas throughout the garment to keep the key areas close to the body of the wearer, such as under the arms.

It should be appreciated that the elastic portions on the isolation garment 100 and the isolation foot ware 200 are continuous elastic portions as shown in the figures. As can be seen in the Figures, the continuous elastic portions are located on both right and left arm sleeves in the wrist and hand area. This elastic portion starts at the inner corner of the wrists portion and continues around the back of the wrist portion and follows the hand downward into a triangular shape in which at the tip of this shape is a loop hole for positioning on the thumb (or any finger if desired). Additional elastic portions are located on the back of the isolation garment 100 and starts at point proximate one side of the wearer's neck and continues along the back opening until it terminates at point proximate the other side of the wearer's neck.

These elastic portions are located to ensure comfortability and maintain freedom of movement without risk of exposure due to each individual's unique body structure (despite gender differences in body composition). Individual body types vary within themselves and aren't always proportionate despite the supposed "set body standard" (arms length outstretched is supposed to equal one's height). Accordingly, the continuous elastic band portions in the isolation garment 100 sleeve's wrist with thumb hook allows for that portion to not ride up and conform to the wearer's unique physical body part type, and ultimately provide better protection against skin exposure to bodily fluids and other contaminants. Moreover, the continuous elastic band portion in the isolation garment 100 back area allows for the isolation garment 100 to better conform to the wearer and provide comfort to the wearer by giving a better range to increase while remaining "fitted" (as though custom tailored to individual's body type) for the universal standard size of the wearer.

Figure 3:
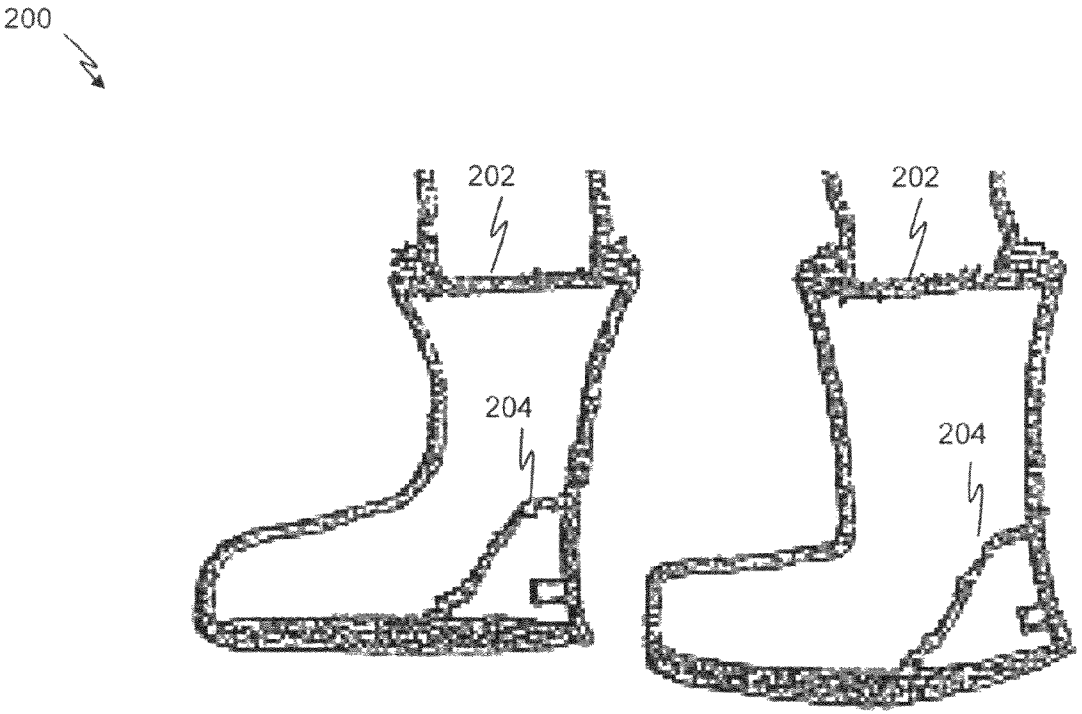
FIG. 3 illustrates a side view of isolation foot ware, in accordance with the present invention.
Figure 4:
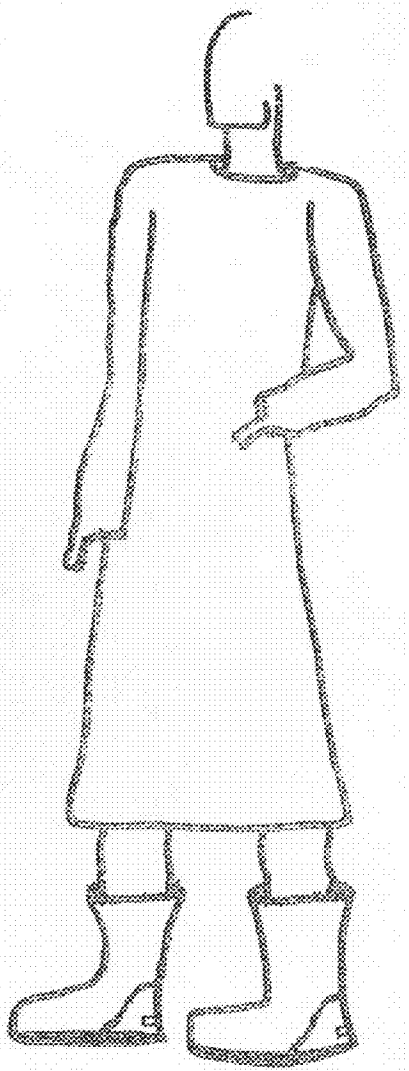
FIG. 4 illustrates a front view of a person wearing the isolation gown of FIG. 1 and the isolation foot ware of FIG. 3, in accordance with the present invention.

Also provided is an isolation foot ware 200, as shown in FIG. 3, wherein the isolation footware 200 is a multifunctional shoe cover which isolates a wearer's shoes from liquids and bodily fluids. Accordingly, similarly to the isolation gown 100, the material used to construct isolation foot ware 200 may also be flame resistant, waterproof, blood stain resistant, and proofed for accumulation of moisture, where the isolation foot ware 200 may be made of quality material provided by Du Pont or other manufacturer. As shown in FIG. 4, the isolation foot ware 200 may be configured to cover a wearer's shoe and a portion of the wearer's leg and may include a leg opening 202 and a heel opening 204 to leave the heal of the wearer's shoe exposed for traction purposes. The heel opening 204 and the leg opening 202 of the isolation foot wear 200 may include elastic boarders to provide a seal from intrusion of liquids and bodily fluids. As such, a wearer simply slips their foot into the leg opening 202 until the isolation foot ware 200 covers the wearer's shoe such that the heel of the wearer's shoe is exposed via the heel opening 204. The elastic portions of the isolation foot ware 200 is then securely contacting the leg of the wearer and the heel of the wearer's shoe. Accordingly, the heel portion 202 of isolation foot ware 200 provides effective protection from slips and falls and allows for free range of movement. Moreover, the isolation foot ware 200 may be configured as one size fits all shoe sizes.

I claim:

1. An isolation gown for covering a body of a wearer, the isolation gown comprising:

a body cover portion, where said body cover portion is configured as a gown to cover the body of the wearer between an area proximate a neck area of the wearer and an ankle area of the wearer, wherein said body cover portion is open near said ankle area of the wearer, two sleeve portions each having an arm opening, wherein each of said two sleeve portions is configured to terminate proximate a wearers hand, such that each arm of the wearer up to an area proximate a hand portion of the wearer is covered by one of said two sleeve portions, wherein each of said arm opening includes a continuous elastic portion to resiliently contact said arm, and a back opening having a tie portion and a continuous elastic portion which traverses the back opening, wherein said tie portion is configured to allow the isolation gown to be secured to the wearer, wherein each of said body cover portion and said two sleeve portions are constructed from a material impervious to liquids.

2. The isolation gown of claim 1, wherein said liquids include at least one of water and bodily fluids.

* * * * *